United States Patent [19]

Moorhead

[11] Patent Number: 4,614,266

[45] Date of Patent: Sep. 30, 1986

[54] MUSICAL GIFT PACKAGE

[76] Inventor: Richard W. Moorhead, 4474 Broad Rd., Syracuse, N.Y. 13215

[21] Appl. No.: 743,825

[22] Filed: Jun. 12, 1985

[51] Int. Cl.[4] ..... B65D 77/00

[52] U.S. Cl. ..... 206/216; 206/45.14; 206/577; 206/566; 229/41 B; 229/41 R; 229/87 A; 40/312; 40/313

[58] Field of Search ..... 206/45.14, 216, 278, 206/566, 577; 40/124.1, 312, 313, 538, 539; 229/41 R, 41 B, 87 R, 87 A

[56] References Cited

U.S. PATENT DOCUMENTS

| | | | |
|---|---|---|---|
| 340,915 | 4/1886 | Hurd | 229/41 B |
| 380,364 | 4/1888 | Surles | 229/41 R |
| 732,964 | 7/1903 | Savacool | 229/41 R |
| 1,088,383 | 2/1914 | Veeder | 229/41 R |
| 1,322,290 | 11/1919 | Cibulka | 229/41 R |
| 2,188,750 | 1/1940 | Hacker | 40/312 |
| 3,119,494 | 1/1964 | Rosenstiel | 206/216 |
| 3,225,920 | 12/1965 | Reilly | 229/87 A |
| 3,571,958 | 3/1971 | Stevens | 40/124.1 |
| 4,286,399 | 9/1981 | Funahashi et al. | 40/124.1 |
| 4,299,041 | 11/1981 | Wilson | 40/124.1 |

OTHER PUBLICATIONS

United States Box Corp., Jan., 1982, pp. 19 and 27.

*Primary Examiner*—Joseph Man-Fu Moy
*Assistant Examiner*—David T. Fidei
*Attorney, Agent, or Firm*—Charles S. McGuire

[57] ABSTRACT

A gift package is disclosed having a box portion cut from a blank of paperboard, or other suitable material, to be formed with a bottom wall and side walls connected thereto along respective fold lines to extend upwardly and, preferably, diverge outwardly to a small degree toward the top. The side walls are not joined to one another, but may be maintained in the upright position by a close-fitting cover comprising a top wall with depending, joined sides to enclose the upper portions of the box side walls. When the cover is removed, the box side walls fall open to a flat position, thereby exposing the box contents and activating a sound-producing micro-chip containing an electronically encoded melody which thus automatically "plays" when the cover is removed. An attractive inner lining covering the bottom and side walls is also preferably provided.

5 Claims, 3 Drawing Figures

MUSICAL GIFT PACKAGE

BACKGROUND OF THE INVENTION

The present invention relates to special gift packages and, more particularly, to a novel and attractive gift box and cover including sound-producing means.

Since the advent of integrated circuits many applications have been proposed for electronically operated apparatus packaged in a very small space, including DC powered microcircuits having means for producing audible tones of various pitches. The circuit may be programmed to produce a sequence of electronically synthesized tones simulating familiar melodies. Such circuits, packaged in the form of so-called "chips," have been incorporated, for example, with greeting cards adapted, when opened, to "play" a melody suited to the occasion and the message on the card.

The present invention has as a principal object the provision of a novel package intended to contain a gift item and incorporating a sound-producing micro-circuit.

A further object is to provide a gift package including a box and a cover wherein, upon removal of the cover, the side walls of the box open to display a gift item and simultaneously actuate minature, electronic sound-producing means to synthetically reproduce a familiar melody connected with the gift-giving occasion.

Other objects will in part be obvious and will in part appear hereinafter.

SUMMARY OF THE INVENTION

In accordance with the foregoing objects, the invention contemplates a musical gift package including a box having bottom and side walls, a separate cover having a top wall and depending sides with a configuration adapted to closely enclose the upper, marginal portion of the box side walls, and a sound-producing electronic micro-circuit. The bottom and side walls are cut from a single blank of sheet material with the side walls joined to the bottom wall along fold lines and extending outwardly therefrom when lying flat. When raised upwardly about the fold lines, the side walls meet along their adjacent side edges, but are not permanently joined. In this position, the side walls preferably diverge outwardly from the bottom wall whereby, unless otherwise retained, they fall outwardly to their original position, essentially coplanar with the bottom wall.

An electronic circuit having elements capable of emitting tones of predetermined pitch in a programmed sequence is packaged in a small, unitary "chip" and includes means providing the necessary DC electric power to the circuit. The chip is incorporated in the box structure in such a way that the circuitry is actuated, i.e., power is supplied thereto, upon movement of the side walls to the outer position, substantially coplanar with the bottom wall. The chip is programmed so that the tones emitted simulate a familiar melody connected with a gift-giving occasion.

The cover may be placed over the upper edges of the side walls as the latter are manually held in the upright position and, due to the close fitting engagement of the depending sides of the cover about the box side walls, will serve to retain them in such position. When the cover is removed, the side walls will fall outwardly by gravity due to their outwardly diverging configuration. An attractive lining covers the interior of the bottom and side walls, preferably being folded inwardly at the corners so as to provide a continuous, unbroken outline when in the flat or extended position. An appropriate switch in the electronic circuit is closed to actuate the sound-producing means in response to movement of the box side walls from the upright to the extended position.

DETAILED DESCRIPTION

Figure 1:
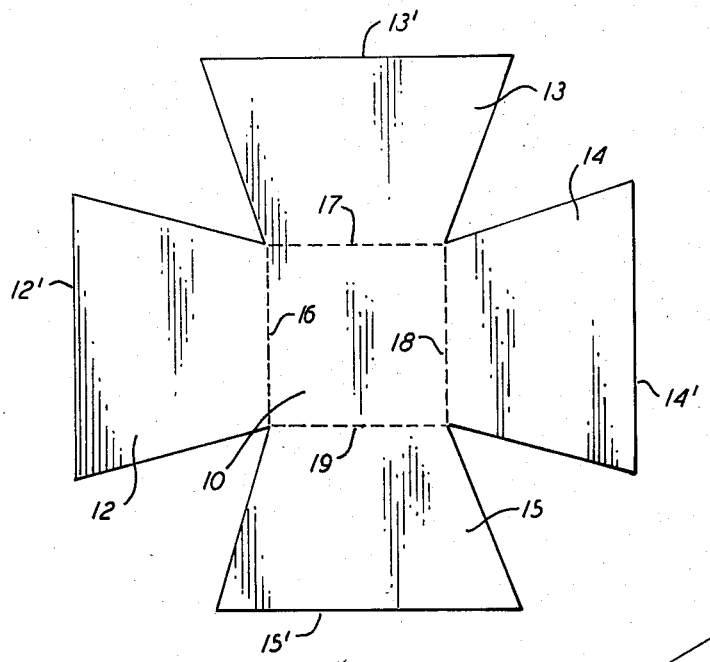
FIG. 1 is a plan view of a blank of sheet material cut to form the gift box of the invention.

Referring now to the drawing, in FIG. 1 is shown a flat blank of material such as paperboard or other suitable box-making material, comprising bottom wall 10 with side walls 12, 13, 14 and 15 extending outwardly therefrom along fold lines 16, 17, 18 and 19, respectively. The side edges of side walls 12, 13, 14 and 15 diverge to some degree from the respective fold line connections to bottom wall 10 to edges $12^1$, $13^1$, $14^1$ and $15^1$. Thus, when the side walls are moved upwardly about the respective fold lines to bring the side edges of adjacent walls into contact, the dimensions about the top of the box are larger than about the fold lines.

Figure 2:
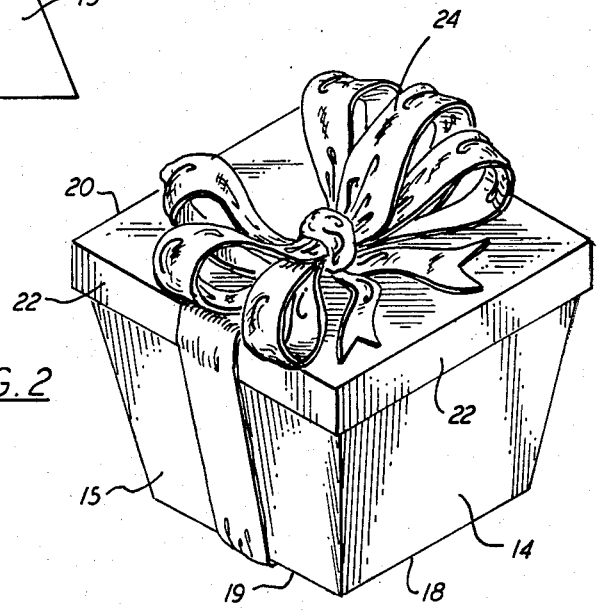
FIG. 2 is a perspective view of the gift package in the closed position.

The gift package is shown in FIG. 2 in the closed position, with the sides in their upright positions. The edges of adjacent side walls meet, but are not joined to one another. A cover member is formed in conventional manner to include top wall 20 and four depending sides 22, two of which are seen in the perspective view of FIG. 2. Sides 22 of the cover closely enclose the upper marginal portions of box side walls 12, 13, 14 and 15, thus preventing the latter from falling outwardly to their original, coplanar position. The appearance of the gift package may be enhanced in the usual ways, as with ribbon 24, an additional paper wrapping or an attractive layer of foil, fabric, etc., permanently secured to the exterior surfaces of the gift package.

Figure 3:
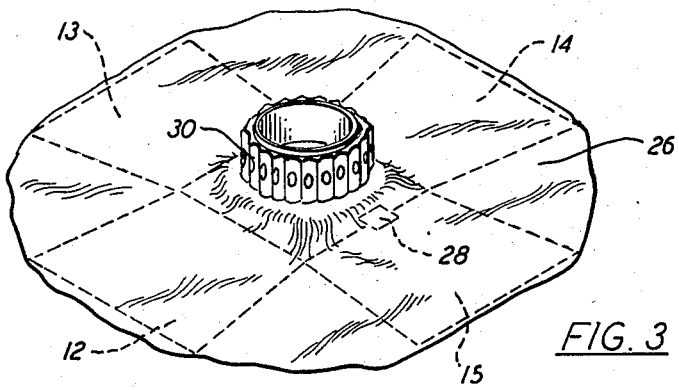
FIG. 3 is a perspective view of the gift box in the open position, displaying a gift item.

When the cover is lifted off the box, side walls 12, 13, 14 and 15 fall outwardly by gravity, due to the upward divergence of the walls. The box is shown in FIG. 3 after the cover has been removed, with the side walls in the outward, coplanar position. Also preferably included, as shown in FIG. 3, is an interior lining 26 of an attractive fabric such as velvet, satin, etc., secured to and covering interior surfaces of the bottom and side walls. Lining 26 may have a periphery extending between the side edges of box side walls 12, 13, 14 and 15, thus providing an essentially continuous outline in the open position of the box. The portions of lining 26 between adjacent side walls would be folded interiorly of the box, and thus not visible, when it is in its closed position.

Also incorporated in the gift package structure is a micro-circuit of a type commercially available which includes means for producing audible sounds at a number of different frequencies in response to electrical stimulus. Such a circuit is contained in the chip indicated in FIG. 3 by reference numeral 28, adjacent to fold line 19 of box side 15. Chip 28 may be either beneath or above fabric liner 28 being actuated, in any case, by movement of the box side walls from their upright to the outwardly extended positions. For example, a suitable pressure switch may be provided to maintain the circuit in an unactivated state until the switch is released by outward movement of side wall 15. Chip 28 includes a minature power source which, upon actuation, provides the necessary electrical power to operate the soundproducing means incorporated in the circuit. These are programmed in known manner to cause a succession of tones, each of predetermined pitch and duration, representing a familiar melody appropriate to the occasion upon which the gift contained by the package of the invention is presented.

The gift package is thus adapted to provide a pleasing effect upon removal of the cover from the box which enhances the enjoyment of the gift presentation, opening outwardly to reveal and attractively display the gift and, at the same time, producing the sounds of an appropriate melody. Since the musical gift package would necessarily be somewhat more expensive than an ordinary gift box, it would be more suitable for use with relatively expensive gifts, such as jewelry item 30, but of course is not limited by the intended contents. The degree of divergence of the sides of the box may be less than that indicated in the drawing, only a slight divergence being necessary to achieve the desired result. Although the simplest and cheapest means of moving the side walls to the outward position upon removal of the cover is by gravity acting upon diverging sides, other means such as springs, etc. could be used to bias the sides outwardly. Boxes having a number of side walls other than the indicated four also could be provided. The positioning of chip 28 upon the box structure would be selected to provide the desired operation of causing the sound to be emitted when the side walls move from the upright to the extended positions, as described, while permitting shipment and storage in a flat condition without actuating the chip until final assembly of the box with the gift item inside. The covers would also be shipped in a flat condition and the side portions thereof assembled at the time of use.

What is claimed is:

1. A musical gift package comprising:

(a) a box portion having a bottom wall and a plurality of side walls integrally attached to said bottom wall and movable with respect thereto between a first position, wherein said bottom and side walls are essentially coplanar, and a second position wherein said side walls extend generally upwardly from said bottom wall and the side edges of each side wall meet the side edges of the adjacent side walls;

(b) a cover portion comprising a top wall with side portions extending downwardly about the periphery thereof;

(c) said cover portion being removably placed upon said box portion when said side walls are in said second position, with said cover side portions closely surrounding the upper marginal portions of said box side walls to prevent movement thereof to said first position;

(d) means for moving said box side walls from said second to said first position in response to removal of said cover portion; and (e) a miniature, sound-producing, electronic circuit and power source affixed to said box portion for actuation to produce a series of tones representing a musical melody in response to movement of said side walls from said second to said first position.

2. The invention according to claim 1 wherein said side walls diverge outwardly from said bottom wall when in said second position and said means for moving said side walls constitutes gravity acting thereon when said cover portion is removed.

3. The invention according to claim 2 and further including a fabric lining affixed to and covering the inner surfaces of said box portion bottom and side walls.

4. The invention according to claim 3 wherein said fabric lining includes portions extending between the side edges of said side walls when the latter are in said first position, whereby said lining presents an essentially continuous outline.

5. The invention according to claim 4 wherein the number of said side walls is four.

* * * * *